US011761457B2

(12) United States Patent
Patel

(10) Patent No.: US 11,761,457 B2
(45) Date of Patent: Sep. 19, 2023

(54) GUIDE DEVICE FOR DIRECTING GAS THROUGH A GAS PRESSURIZING DEVICE

(71) Applicant: ATLAS COPCO (WUXI) COMPRESSOR CO., LTD., Jiangsu (CN)

(72) Inventor: Rakeshkumar Natubhai Patel, Maharashtra (IN)

(73) Assignee: ATLAS COPCO (WUXI) COMPRESSOR CO., LTD., Jiangsu (CN)

( * ) Notice: Subject to any disclaimer, the term of this patent is extended or adjusted under 35 U.S.C. 154(b) by 0 days.

(21) Appl. No.: 17/434,448

(22) PCT Filed: Apr. 10, 2020

(86) PCT No.: PCT/CN2020/084252
§ 371 (c)(1),
(2) Date: Aug. 27, 2021

(87) PCT Pub. No.: WO2020/211706
PCT Pub. Date: Oct. 22, 2020

(65) Prior Publication Data

US 2022/0145902 A1 May 12, 2022

(30) Foreign Application Priority Data

Apr. 16, 2019 (CN) ..... 201910304587.8
Apr. 16, 2019 (CN) ..... 201920513617.1

(51) Int. Cl.
*F04D 29/44* (2006.01)
*F04D 17/12* (2006.01)

(52) U.S. Cl.
CPC ..... *F04D 29/441* (2013.01); *F04D 17/12* (2013.01)

(58) Field of Classification Search
None
See application file for complete search history.

(56) References Cited

U.S. PATENT DOCUMENTS 2,438,426 A * 3/1948 Whittle ..... F04D 17/105 415/191
5,232,342 A * 8/1993 Thompson ..... F04D 1/06 415/199.1

(Continued)

FOREIGN PATENT DOCUMENTS

CH 466492 A 12/1968
CN 101949393 A 1/2011

(Continued)

OTHER PUBLICATIONS

International Search Report in corresponding PCT Application No. PCT/CN2020/084252, dated Jul. 9, 2020.

(Continued)

*Primary Examiner* — David E Sosnowski
*Assistant Examiner* — Arthur Paul Golik
(74) *Attorney, Agent, or Firm* — Bacon & Thomas, PLLC

(57) ABSTRACT

A guide device for directing a gas through gas pressurizing device, includes at least one part-ring shaped guide member having a pair of opposite first end and second end defining a gap therebetween, a lip extending from the guide member, and at least one groove configured in the gas pressurizing device to receive the guide member. The guide device provides a smooth passage to gas flow through a gas pressurizing device by directing gas through the gas pressurizing device, so as to improve efficiency and performance of the gas pressurizing device and eliminate need of fasteners, holes or brackets. The guide device is easy to mount in a gas pressurizing device as compared to conventional baffle ring.

18 Claims, 6 Drawing Sheets

(56) References Cited

U.S. PATENT DOCUMENTS

| | | | | |
|---|---|---|---|---|
| 6,439,835 | B1 * | 8/2002 | Chien | F04D 29/628 415/214.1 |
| 9,217,445 | B2 * | 12/2015 | Lo | F04D 29/547 |

FOREIGN PATENT DOCUMENTS

| | | | |
|---|---|---|---|
| CN | 104696651 | A | 6/2015 |
| CN | 204610381 | U | 9/2015 |
| CN | 106438490 | A | 2/2017 |
| CN | 206957995 | U | 2/2018 |
| CN | 110145496 | A | 8/2019 |
| DE | 1046248 | B | 12/1958 |
| JP | 2008138536 | A | 6/2008 |
| RU | 123865 | U1 | 1/2013 |

OTHER PUBLICATIONS

Written Opinion in corresponding PCT Application No. PCT/CN2020/084252, dated Jul. 9, 2020.
RU Office Action in corresponding RU Application No. 2021128453, dated Jun. 27, 2023.
RU Search Report in corresponding RU Application No. 2021128453, dated Jun. 23, 2023.

* cited by examiner

（conventional technique）

（conventional technique）

（conventional technique）

GUIDE DEVICE FOR DIRECTING GAS THROUGH A GAS PRESSURIZING DEVICE

FIELD OF THE INVENTION

The present disclosure relates to a field of gas transmission technology, and more particularly, to a guide device for directing a gas through gas pressurizing device.

BACKGROUND OF THE INVENTION

In a prior art, a baffle ring is used in a gas pressurizing device, such as a blower, to direct the gas flow through it. A multistage centrifugal blower has various compartments through which process gas/air is circulated. The baffle ring directs the gas into subsequent compartment. Conventionally, such baffle rings are fitted to an inner portion of a blower housing using a bracket. The bracket is fastened to the blower housing as well as to the baffle ring to secure the baffle ring within the housing of the blower. Holes are provided on the baffle ring and the blower housing to receive fasteners that fasten the bracket to the baffle ring and the blower housing. However, such arrangement of the bracket obstructs the gas flow within the housing, which lowers the efficiency and performance of the blower. Further, it is a time consuming task to drill holes in the housing and the baffle ring, and to mount the baffle ring within the blower housing. In another conventional method, the baffle ring is welded to the blower housing. However, this requires more material. Further, welding the baffle ring to the blower housing is a cumbersome task due to space constraint. Therefore, there is felt a need of a guide device for directing a gas through a gas pressurizing device that alleviates the abovementioned drawbacks of the conventional baffle rings.

SUMMARY OF THE INVENTION

Based on the above backwards in the prior art, an object of the present disclosure aims to provide a guide device for directing a gas through a gas pressurizing device and a making method thereof, so as to solve the existing backwards in the prior art that the use of baffle ring will obstruct the gas flow and additional components such as bracket will be increased.

To achieve the above objects, on one hand, the present disclosure provides a guide device for directing a gas through a gas pressurizing device. The guide device includes: at least one part-ring shaped guide member having a pair of opposite first end and second end defining a gap therebetween; a lip extending radially from guide member; and at least one groove configured within the gas pressurizing device to receive the lip.

In some embodiments, an inner surface of the guide member is convex.

In some embodiments, an outer surface of the guide member is concave.

In some embodiments, the lip integrally extends from the outer surface.

In some embodiments, the lip is orthogonal to the first end and the second end, respectively.

In some embodiments, the guide member is arranged between two stages or at interface of two compartments in the gas pressurizing device.

In some embodiments, the guide member is disposed upstream of an impeller in the gas pressurizing device.

In some embodiments, the groove is configured on a fixed vane of an intermediate member arranged in the gas pressurizing device.

In some embodiments, the first end and second end of the guide member subtend an angle ranging from 5° to 20° with the center of the guide member.

In some embodiments, the first end and second end of the guide member subtend an angle ranging from 8° to 15° with the center of the guide member.

In some embodiments, the first end and second end of the guide member subtend an angle ranging from 10° to 12° with the center of the guide member.

In some embodiments, the guide member is resilient.

In some embodiments, the lip is removably received in the groove.

In some embodiments, the guide device includes a plurality of guide members.

In some embodiments, the guide member is made of metallic material.

On the other hand, the present disclosure provides a method of making a guide device for directing a gas through a gas pressurizing device. The method includes the following steps: forming a part-ring shaped guide member; providing a lip on the guide member, the lip extending radially from the guide member; configuring a groove in the gas pressurizing device; and mounting the guide member in the pressurizing device by inserting the lip in the groove.

In some embodiments, the groove is configured on a fixed vane of an intermediate member arranged in the gas pressurizing device.

In some embodiments, the intermediate member is made by casting.

Compared to conventional technique, the present disclosed embodiments provide a smooth passage to gas flow through a gas pressurizing device by directing gas through gas pressurizing device, so as to improve efficiency and performance of a gas pressurizing device and eliminate need of fasteners, holes or brackets. The guide device is easy to mount in a gas pressurizing device as compared to conventional baffle rings.

It should be understood that the foregoing general description and the detailed description below are illustrative and exemplary and cannot be construed to limit the present disclosure.

The present disclosure provides a general summary of the various embodiments or examples of techniques described herein, and is not a comprehensive disclosure of the full scope or all the features of the techniques disclosed herein.

BRIEF DESCRIPTION OF THE DRAWINGS

In the drawings which are not necessarily drawn to scale, same reference signs may represent similar components in different views. The same reference numerals with suffix letters or different suffix letters may represent different embodiments of the similar components. The drawings generally show the various embodiments by illustration rather than limitation, and illustrate the disclosed embodiments with reference with the specification. When appropriate, the same reference signs used in all the drawings refer to the same or similar parts, and such an embodiment is illustrative and is not intended as an exhaustive or exclusive embodiment of the present device or method.

LIST OF REFERENCE NUMERALS

100—Conventional guide device
102—Blower
105—Inner surface of housing
110—Conventional bracket
112—Holes on bracket
130—Conventional baffle ring
135—Holes on baffle ring
200—Guide device of the present disclosure
210—Guide member
212—Gap
215—Inner surface
220—Outer surface
225—Lip
230—First end
235—Second end
250—Groove
270—Inner surface of housing
290—Gas pressurizing device
300—Intermediate member
310—Rotating shaft
α—Angle subtended by opposite ends of guide member

DETAILED DESCRIPTION OF THE INVENTION

The technical solutions of the present disclosure are described clearly and thoroughly as follows with reference to the accompanying drawings such that the objects, technical solutions and advantages of the present disclosure is more apparent. Obviously, the embodiments described are a part of embodiments of the present disclosure rather than all of embodiments. Base on the embodiments described in the present disclosure, other embodiments obtained by those skilled in the related art without creative labor belong to the scope of the protection of the present disclosure.

The technical and scientific terminologies used in the present disclosure shall be construed as general meanings by those skilled in the related art. Terms such as first, second or similar terms, used herein do not imply a specific sequence, number or significance, but merely distinguish different components. Terms such as "comprise", "includes" or similar terms refer to elements or objects before these terms contains the elements or objects and their equivalent after theses terms, but do not exclude other elements or objects. Terms such as "connected", or "coupled" and similar terms are not limited to a physical or mechanical connection, but may comprise an electronic connection directly or indirectly. Terms such as "up", "down", "left", "right" and the like are merely used to indicate relative position, and when the absolute position of the described object changes, the relative position may also change accordingly.

Detailed descriptions of well-known functions and components in the present disclosure are omitted so as to keep the following descriptions clear and concise.

Figure 1:
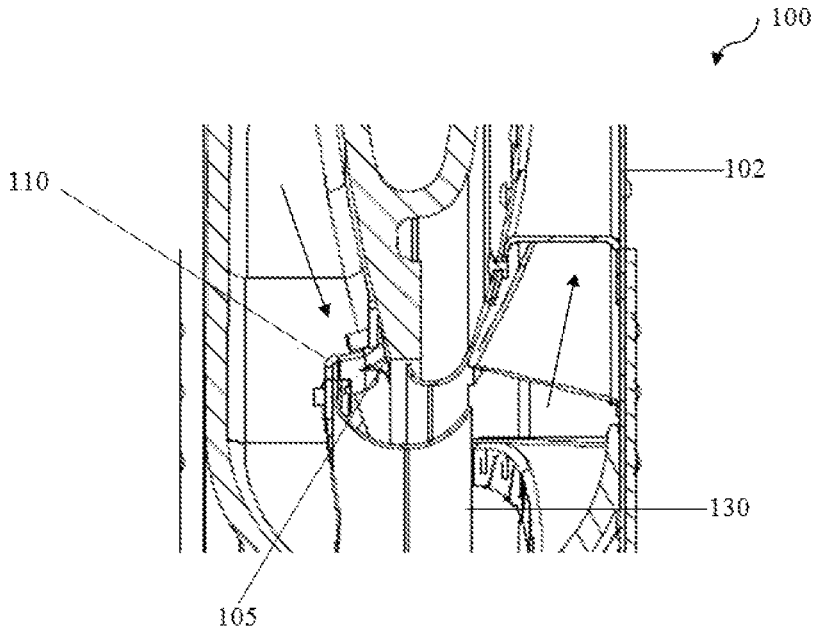
FIG. 1 illustrates a schematic view of a conventional guide device in a gas pressurizing device.

The present embodiments relate to a guide device for directing a gas through a gas pressurizing device. FIG. 1 illustrates a schematic view of a conventional guide device 100 for directing a gas through a gas pressurizing device, and in the embodiment illustrated in FIG. 1, the gas pressurizing device is typically a blower 102. The conventional guide device 100 includes a conventional baffle ring 130 arranged in the blower 102. The baffle ring 130 is fastened on the inner surface 105 of the housing of the blower 102 using the bracket 110, and the gas flows in the blower 102 by the baffle ring 130.

Figure 2:
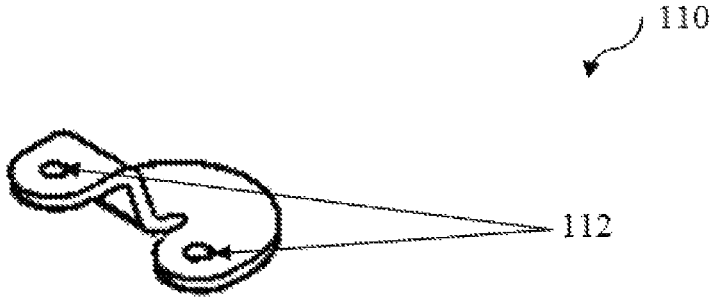
FIG. 2 illustrates a schematic view of a conventional bracket of the conventional guide device in FIG. 1.

FIG. 2 illustrates a schematic view of a conventional bracket 110 used to mount the baffle ring 130 on an inner surface 105 of a housing of the blower 102. Specifically, in the conventional guide device 100, the baffle ring 130 is mounted on the inner surface 105 of the housing of the blower 102 using the bracket 110. The holes 112 on bracket is configured on the conventional bracket 110. The holes 112 on bracket are configured to receive fasteners for connection, and the fasteners are used for fixed connection between mutual devices.

Figure 3:
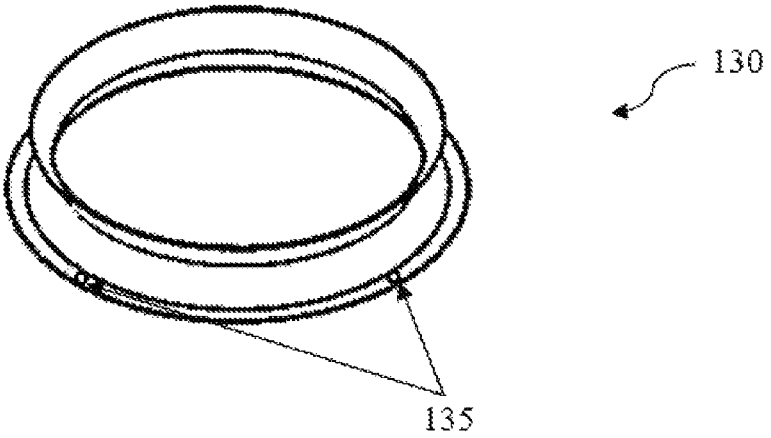
FIG. 3 illustrates a schematic view of a conventional baffle ring.

More specifically, the one end of the conventional bracket 110 is connected to the inner surface 105 of the housing of the blower 102, while the other end is connected to the baffle ring 130, such that the baffle ring 130 is mounted on the inner surface 105 of the housing of the blower 102. The configuration of the baffle ring 130 is shown in FIG. 3. The baffle ring 130 is provided with holes 135 which register with one of the holes 112 configured on the conventional bracket 110. The conventional bracket 110 is then fastened to the baffle ring 130 and the housing of the blower 102 using the fasteners that pass through the holes 112 on bracket and the holes 135 on baffle ring in sequence.

In practical use, the baffle ring 130 needs to be mounted at multiple locations in the housing of the blower to guide gas to flow. Thus, the conventional guide device 100 may be used at several locations per stage in the housing of the blower 102 as long as the baffle ring 130 is to be connected to the housing of the blower 102.

However, when the conventional guide device 100 are mounted on the housing of the blower 102, the conventional guide device 100 requires more time to assemble due to requirement of drilling of holes on every baffle ring 130 to facilitate connection. The gas flow gets partially obstructed in the blower 102 due to the arrangement of the baffle ring 130, the bracket 110, and fasteners. The flow obstruction to the gas reduces its velocity which further results in adversely affecting the performance of the blower 102 and reducing the efficiency of the blower 102. Further, such flow obstruction can create turbulence in the gas flow which is not desirable. Further, the conventional guide device 100 has higher manufacturing cost, assembly cost and inventory cost.

The present disclosure envisages a guide device for directing a gas through a gas pressurizing device that eliminates need of a bracket, fasteners and the corresponding connection holes, and does not obstruct the gas flow through the gas pressurizing device.

Figure 4:
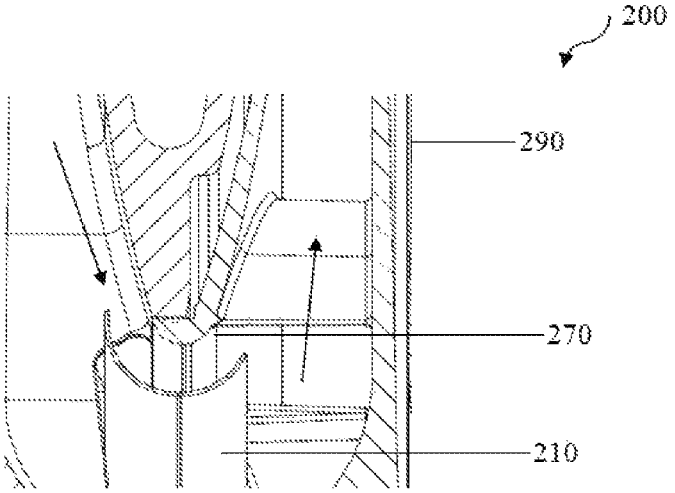
FIG. 4 illustrates a sectional view of a guide device in accordance with an embodiment of the present disclosure.

FIG. 4 illustrates a sectional view of a guide device in accordance with an embodiment of the present disclosure. The guide device 200 is configured for directing a gas through a gas pressurizing device. The term "gas" refers to a single gas or mixture of gases. In one embodiment, the gas is air.

The gas pressurizing devices are any devices that pressurize gas received therein. The gas pressurizing devices include low-pressure devices, such as a blower or high pressure devices such as a compressor. For better explanation of the embodiments of the present disclosure, in the present embodiment, the gas pressurizing device 290 is a blower. The blower has at least one stage. In another embodiment, the blower is a multi-stage blower with multiple stages.

Figure 5:
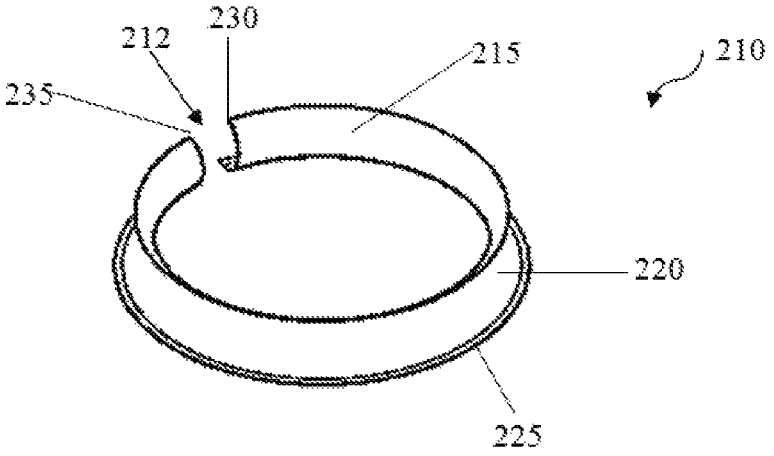
FIG. 5 illustrates a schematic view of a guide member of the guide device in FIG. 4.

FIG. 4 and FIG. 5 are schematic view and sectional view of the guide member 210 of the guide device 200 respectively in accordance with an embodiment of the present disclosure. The guide device 200 includes at least one guide member 210 and a corresponding lip 225. In one embodiment, for example, in a multistage blower, the guide device 200 includes at least two guide members 210. At least one of the guide members 210 may be a part-ring shaped structure. The part-ring shaped body refers to a body having a substantially circular configuration rather than a complete ring, and the ends of the guide member 210 defines a gap therebetween.

The guide members 210 in the guide device 200 can be arranged in the gas pressurizing device 290 at suitable locations where the gas flow needs to be guided. For example, the guide member 210 is arranged between two stages or at each interface of two subsequent compartments in the gas pressurizing device 290, and the guide member 210 is configured for directing a gas from one stage to a subsequent stage or from one compartment to subsequent compartment of the gas pressurizing device 290. In another embodiment, the guide member 210 is arranged upstream of an impeller in the gas pressurizing device 290 so as to efficiently direct the gas from the upstream of an impeller in the gas pressurizing device 290 to the entry of the impeller.

The structure of the guide member is illustrated in FIG. 5. The guide member 210 has an operative inner surface 215 and an operative outer surface 220. In an embodiment, the operative outer surface 220 of the guide member 210 is a smooth concave surface, and the operative inner surface 215 is convex surface, such an arrangement facilitating directing gas to flow.

The outer surface 220 of the guide member 210 defines a path for directing a gas in an axial direction with respect to the guide member 210. Further, each of the edges of the outer surface 220 has smooth curvature to direct gas to flow.

Referring to FIG. 5, since the guide member 210 is a part-ring structure rather than a closed structure, the guide member 210 has a pair of opposite ends which are a first end 230 and a second end 235. The configuration of the guide member 210 is such that a gap 212 is defined between the first end 230 and the second end 235, and configuration of the gap 212 facilitates mounting the guide member 210.

More specifically, the guide member 210 has a circular or substantially circular configuration. The first end 230 and the second end 235 subtend an angle ($\alpha$) which ranges from 5° to 20° with the center of the guide member 210. In one embodiment, the first end 230 and the second end 235 subtend an angle ($\alpha$) which ranges from 8° to 15° with the center of the guide member 210. In another embodiment, the first end 230 and the second end 235 subtend an angle ($\alpha$) which ranges from 10° to 12° with the center of the guide member 210.

In order to facilitate mounting the guide member 210, the guide member 210 is resilient in nature. During mounting in the gas pressurizing device 290, the guide member 210 offers spring effect similar to that of a circlip. More specifically, the guide member 210 is pressed inwardly while mounting in the gas pressurizing device 290. When the force on the guide member 210 is released, the guide member 210 regains its original shape due to its resilient nature so as to be fixedly mounted on the gas pressurizing device 290.

Further, the guide member 210 can be of any material. In one embodiment, the guide member 210 is made of metallic material. The metallic material can provide strength and rigidity to the guide member 210 required for practical operation and use in the gas pressurizing device 290.

As mentioned above, the guide device 200 includes at least one guide member 210, a lip 225 and at least one groove 250. Specifically, the lip 225 in the guide device 200 extends radially from an outer edge of the guide member 210. In one embodiment, during the manufacturing process, the lip 225 and the guide member 210 are integrated manufacturing. In another embodiment, the lip 225 extends from an edge of the operative outer surface 220 of the guide member 210. In yet another embodiment, the lip 225 is orthogonal to the first end 230 and the second end 235 of the guide member 210 respectively.

Figure 7:
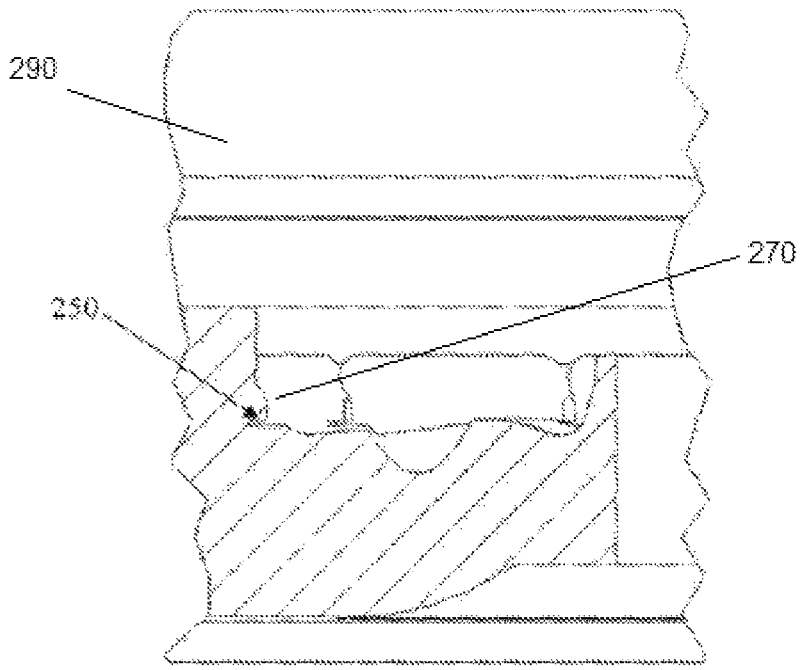
FIG. 7 illustrates a schematic view of a groove of the guide device in FIG. 5.

Further, as illustrated in FIG. 7, the guide device 200 also includes at least one groove 250 configured in the gas pressurizing device, more specifically, on an operative inner surface 270 of the gas pressurizing device 290. The groove 250 is configured to receive the lip 225 in the guide device 200, thereby securing the guide member 210 in the gas pressurizing device 290 by using the groove 250. In another embodiment, the lip 225 is removably received in the groove 250.

In one embodiment, since the guide member 210 is resilient in nature, the guide member 210 is fitted in the groove 250 by displacing the first end 230 and the second end 235 towards each other to elastically deform the guide member 210.

Figure 8:
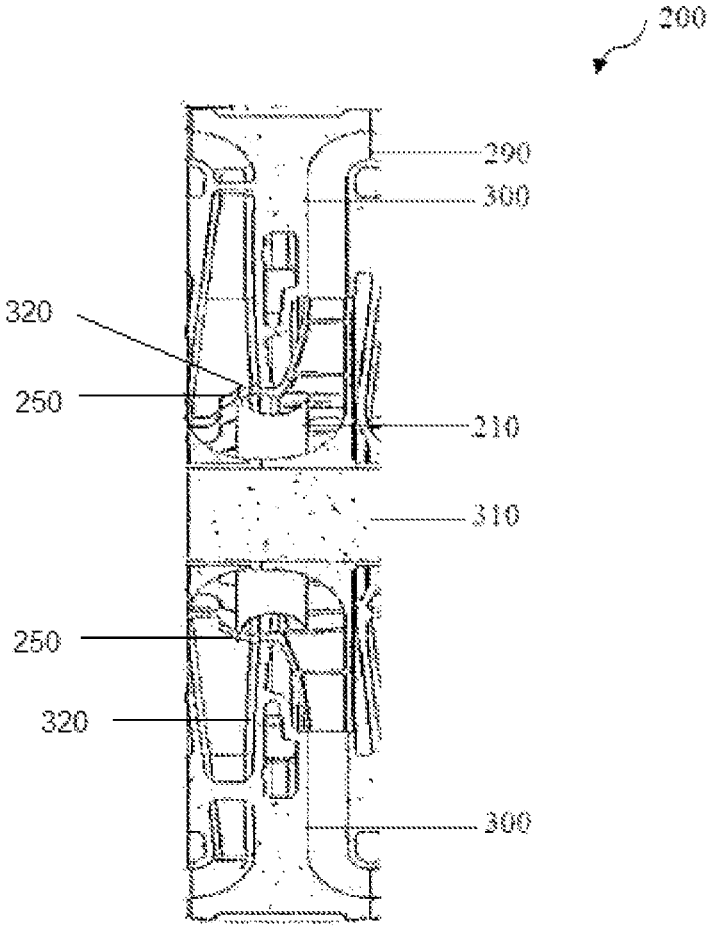
FIG. 8 illustrates a schematic view of mounting a guide device in accordance with an embodiment of the present disclosure.
Figure 9:
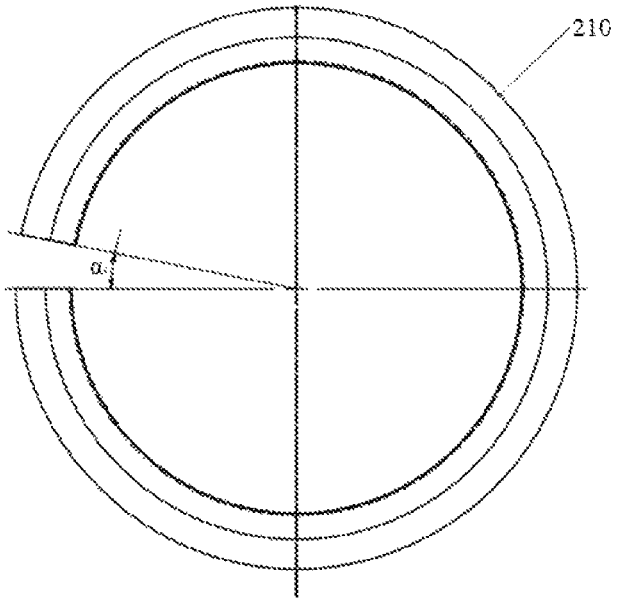
FIG. 9 illustrates a sectional view of a guide member of the guide device in FIG. 4.

In one embodiment, as illustrated in FIG. 8, the groove 250 is configured on fixed vanes 320 of an intermediate member 300 arranged within the gas pressurizing device 290. The intermediate member 300 is a circular part acting as a housing to the gas pressurizing device 290. The gas pressurizing device 290 includes a plurality of intermediate members 300 arranged within the gas pressurizing device 290, and these intermediate members 300 are configured to define a number of stages in the gas pressurizing device 290.

Figure 6:
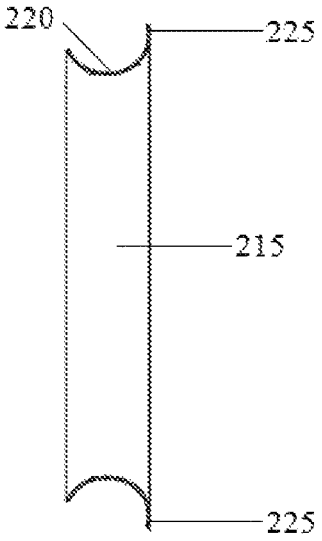
FIG. 6 illustrates a schematic view of a lip of the guide device in FIG. 5.

More specifically, in the gas pressurizing device 290, impellers not shown) are mounted on a rotating shaft 310 of the gas pressurizing device 290, and each impeller is arranged between two subsequent intermediate members 300. Fixed vanes 320 are provided on each of the intermediate members 300 to direct the gas flow. The groove 250 is configured at the edges of the fixed vanes 320 of each intermediate member 300 to receive the guide member 210 (i.e., the lip 225 shown in FIGS. 5 and 6).

In one embodiment, the intermediate members 300 are made by a casting process, and seals are provided between the rotating shaft 310 and the intermediate members 300.

During the practical mounting process, the dimensions of the groove 250 are configured such that the lip 225 on the guide member 210 can be securely received in the groove 250. More specifically, the dimensions of the groove 250 and the lip 225 of the guide member 210 are such that, once mounted, the guide member 210 does not get dislocated from its position.

To mount the guide member 210 on the intermediate member 300, the guide member 210 can be pressed inwardly such that the first end 230 and the second end 235 of the guide member 210 come closer or overlap. The pressed guide member 210 is then placed within the housing of the gas pressurizing device 290 such that the lip 225 is received in the groove 250. Further, once the external force pressed on the guide member 210 is released, the guide member 210 will deform to expand, which will properly position the guide member 210 in the housing instead of dislocation.

As mentioned above, during the process of mounting and using, the guide device 200 does not require any bracket, fasteners, or drilling of holes on guide members or housing to fasten. Thus, the guide device 200 offers minimum resistance to the gas flow, thereby increasing the efficiency and performance of the gas pressurizing device. Further, mounting of the guide member 210 is much easier as compared to that of conventional guide members.

The present disclosure further envisages a method of making the guide device 200 for directing a gas through a gas pressurizing device 290. The method comprises the following steps:

forming a part-ring shaped guide member 210;

forming a path on the outer surface 220 of the guide member 210 to guide the gas through the gas pressurizing device 290;

providing a lip 225 on the guide member 210, wherein the lip 225 extends radially from an edge of the guide member 210;

configuring a groove 250 in the gas pressurizing device 290;

mounting the guide member 210 in the gas pressurizing device 290 by inserting the lip 225 in the groove 250; and configuring the groove 250 on a fixed vane 320 of an intermediate member 300 arranged in the gas pressurizing device 290.

The foregoing description of the embodiments has been provided for purposes of illustration rather than limitation. For example, those skilled in the related art may practice other embodiments after reading the above descriptions. Further, in the above specific embodiments, various features can be grouped together to simplify the disclosure. On the contrary, the subject matter of the present disclosure may be less than all features of a specific disclosed embodiment.

The above embodiments are merely exemplary embodiments of the present disclosure and not construed as limiting the scope of the present disclosure. Those skilled in the art may make various modifications or equivalent substitutions to the present disclosure within the essence and protection scope of the present disclosure, and such modifications or equivalent substitutions should be considered to be within the scope of the present disclosure.

What is claimed is:

1. A gas pressurizing device having a guide device for directing a gas through a gas pressurizing device, said guide device comprising:

at least one guide member having a ring-shaped body with a gap, said at least one guide member having a first end and second end defining said gap therebetween;

a lip extending radially from said guide member; and at least one groove configured within said gas pressurizing device to receive said lip, wherein said ring-shaped body is resilient to enable said first end and said second end to be moved towards each other upon application of a force during installation of said at least one guide member in the gas pressurizing device, causing the ring-shaped body to deform and the lip to pass an inner surface of the gas pressurizing device until the lip is aligned with the at least one groove, the ring-shaped body regaining its undeformed shape and entering the groove upon release of the force to fixedly mount the at least one guide member in the gas pressurizing device without a bracket.

2. The gas pressurizing device as claimed in claim 1, wherein said lip is orthogonal to said first end and said second end.

3. The gas pressurizing device as claimed in claim 1, wherein the inner surface of said at least one guide member is convex.

4. The gas pressurizing device as claimed in claim 1, wherein the outer surface of said at least one guide member is concave.

5. The gas pressurizing device as claimed in claim 4, wherein said lip integrally extends from said outer surface.

6. The gas pressurizing device as claimed in claim 1, wherein said at least one guide member is arranged between two stages or at an interface of two compartments in said gas pressurizing device.

7. The gas pressurizing device as claimed in claim 1, wherein said first end and second end of said at least one guide member subtend an angle ranging from 5° to 20° with the center of said guide member.

8. The gas pressurizing device as claimed in claim 1, wherein said first end and second end of said at least one guide member subtend an angle ranging from 8° to 15° with the center of said guide member.

9. The gas pressurizing device as claimed in claim 1, wherein said first end and second end of said at least one guide member subtend an angle ranging from 10° to 12° with the center of said guide member.

10. The gas pressurizing device as claimed in claim 1, wherein said at least one guide member is resilient.

11. The gas pressurizing device as claimed in claim 1, wherein said lip is removably received in said at least one groove.

12. The gas pressurizing device as claimed in claim 1, wherein said guide device comprises more than one of said at least one guide member.

13. The gas pressurizing device as claimed in claim 1, wherein said at least one guide member is made of metallic material.

14. A guide device for directing a gas through a gas pressurizing device, comprising:

at least one guide member having a ring-shaped body with a gap, said at least one guide member having a first end and second end defining said gap therebetween;

a lip extending radially from said guide member; and at least one groove configured within said gas pressurizing device to receive said lip, wherein said ring-shaped body is resilient to enable said first end and said second end to be moved towards each other upon application of a force during installation of said at least one guide member in the gas pressurizing device, causing the ring-shaped body to deform and the lip to pass an inner surface of the gas pressurizing device until the lip is aligned with the at least one groove, the ring-shaped body regaining its undeformed shape and entering the groove upon release of the force to fixedly mount the at least one guide member in the gas pressurizing device without a bracket, wherein said at least one guide member is disposed upstream of an impeller in said gas pressurizing device.

15. A guide device for directing a gas through a gas pressurizing device, comprising:

at least one guide member having a ring-shaped body with a gap, said at least one guide member having a first end and second end defining said gap therebetween;

a lip extending radially from said guide member; and at least one groove configured within said gas pressurizing device to receive said lip, wherein said ring-shaped body is resilient to enable said first end and said second end to be moved towards each other upon application of a force during installation of said at least one guide member in the gas pressurizing device, causing the ring-shaped body to deform and the lip to pass an inner surface of the gas pressurizing device until the lip is aligned with the at least one groove, the ring-shaped body regaining its undeformed shape and entering the groove upon release of the force to fixedly mount the at least one guide member in the gas pressurizing device without a bracket, wherein said at least one groove is configured on a fixed vane of an intermediate member arranged in said gas pressurizing device.

16. A method of making a guide device for directing a gas through a gas pressurizing device, said method comprising the following steps:

forming a resilient ring-shaped guide member with a gap defined by a first end and a second end of the ring-shaped guide member;

providing a lip on said resilient ring-shaped guide member, said lip extending radially from said resilient ring-shaped guide member;

configuring a groove in said gas pressurizing device; and mounting said resilient ring-shaped guide member in said pressurizing device by inserting said lip in said groove, wherein the step of mounting said resilient ring-shaped guide member in said pressurizing device includes steps of:

applying force to move said first end and said second ends to end towards each other and deform the resilient ring-shaped guide member, thereby causing the lip to pass an inner surface of the gas pressurizing device until the lip is aligned with the groove with the one groove, and releasing the force to enable the lip to enter the groove as the resilient ring-shaped guide member regains its undeformed shape, thereby fixedly mounting the resilient ring-shaped guide member in the gas pressurizing device without a bracket.

17. The method as claimed in claim 16, wherein said groove is configured on a fixed vane of an intermediate member arranged in said gas pressurizing device.

18. The method as claimed in claim 17, wherein said intermediate member is made by casting.

* * * * *